US006036129A

United States Patent [19]

Ambrose

[11] Patent Number: 6,036,129

[45] Date of Patent: Mar. 14, 2000

[54] ECCENTRIC CONE CRUSHER HAVING MULTIPLE COUNTERWEIGHTS

[75] Inventor: David W. Ambrose, Mequon, Wis.

[73] Assignee: ANI Mineral Processing, Inc., Brookfield, Wis.

[21] Appl. No.: 09/172,987

[22] Filed: Oct. 14, 1998

[51] Int. Cl.[7] ..... B02C 2/04

[52] U.S. Cl. ..... 241/207; 241/208; 241/210; 241/215

[58] Field of Search ..... 241/207, 208, 241/210, 215, 214

[56] References Cited

U.S. PATENT DOCUMENTS

| | | | |
|---|---|---|---|
| 2,168,582 | 8/1939 | Rider | 241/210 |
| 3,908,916 | 9/1975 | Klushantsev et al. | 241/213 |
| 4,073,446 | 2/1978 | Rudkvist et al. | 241/207 |
| 4,452,401 | 6/1984 | Zarogatsky et al. | 241/207 |
| 4,478,373 | 10/1984 | Gieschen | 241/208 |
| 4,566,638 | 1/1986 | Lundin et al. | 241/37 |
| 4,588,137 | 5/1986 | McConnell, Jr. | 241/156 |
| 4,589,600 | 5/1986 | Schuman | 241/215 |
| 4,592,517 | 6/1986 | Zarogatsky et al. | 241/207 |
| 4,615,491 | 10/1986 | Batch et al. | 241/37 |
| 4,655,405 | 4/1987 | Zarogatsky et al. | 241/215 |
| 4,697,745 | 10/1987 | Sawant et al. | 241/30 |
| 4,750,679 | 6/1988 | Karra et al. | 241/41 |
| 4,750,681 | 6/1988 | Sawant et al. | 241/208 |
| 4,844,362 | 7/1989 | Revnivtsev et al. | 241/210 |
| 4,976,470 | 12/1990 | Arakawa | 241/37 |
| 5,540,393 | 7/1996 | Stafford et al. | 241/30 |
| 5,540,394 | 7/1996 | Bremer et al. | 241/30 |
| 5,718,390 | 2/1998 | Gasner, IV et al. | 241/36 |
| 5,799,885 | 9/1998 | Karra | 241/30 |

*Primary Examiner*—John M. Husar
*Attorney, Agent, or Firm*—Michael Best & Friedrich LLP

[57] ABSTRACT

An eccentric cone crusher having multiple counterweights. More particularly, the present invention provides a cone crusher including a frame, a crusher head for eccentric rotation about an axis, an eccentric member supporting the crusher head and having a center of gravity off the axis of eccentric rotation, and at least two counterweights attached to the eccentric. Utilizing more than one counterweight permits greater flexibility in positioning the counterweights, and minimizes moments and other stresses on the apparatus.

39 Claims, 2 Drawing Sheets

ECCENTRIC CONE CRUSHER HAVING MULTIPLE COUNTERWEIGHTS

FIELD OF THE INVENTION

The present invention generally relates to the field of crushers used to crush aggregate into smaller pieces. More specifically, the present invention relates to eccentric cone crushers.

BACKGROUND OF THE INVENTION

Crushers are used to crush large particles (e.g., rocks) into smaller particles. One particular type of crusher is known as a cone crusher. A typical cone crusher includes a frame supporting a crusher head and a mantle secured to the head. A bowl and bowl liner are supported by the frame so that an annular space is formed between the bowl liner and the mantle. In operation, large particles are fed into the annular space between the bowl liner and the mantle. The head, and the mantle mounted on the head, gyrate about an axis, causing the annular space to vary. As the distance between the mantle and the bowl liner varies, the large particles are impacted and compressed between the mantle and the bowl liner. The particles are crushed and reduced to the desired product size, and then dropped down from between the mantle and the bowl liner.

U.S. Pat. No. 4,750,681, which issued to Sawant et al. on Jun. 14, 1988, discloses such a cone crusher. The crusher includes a head 146 which is supported on a cylindrical support shaft 30. Eccentric 48 is rotatable about the shaft 30 and is attached to the head 146. The shape of the counterweight 55 is designed to compensate for the mass eccentricity of the eccentric 48 and head assembly 144 so that the assembly of eccentric 48, counterweight 55 and head assembly 144 is balanced to produce no net horizontal forces on the foundation when the mantle 150 is half worn.

SUMMARY OF THE INVENTION

One of the problems with existing eccentric cone crushers is effectively balancing the eccentric distribution of mass of the head assembly. Gyration of the head assembly during crusher operation creates significant forces and moments which must be negated or "zeroed" as much as possible so that the adverse effects of unbalanced forces and moments on the cone crusher foundation and/or mounting structure are mimimized.

Thus, as illustrated by the Sawant '681 reference, it is known to provide the crusher with a counterweight assembly which rotates in common with the crusher head assembly. Ideally, the mass distribution of the counterweight would be such as to perfectly balance the mass distribution of the eccentric and head assemblies with respect to the axis of gyration of the head assembly. However, such an ideal mass distribution is not achievable in many crusher designs due to the close clearances of the individual components of the cone crusher, and the generally large size of the counterweight needed to offset the mass distribution of the head assembly. Also, depending on the structure used to support the head assembly for rotation, the crusher construction may provide few suitable locations that are available to accommodate the counterweight.

As a result of these limitations, prior art crushers typically include counterweight assemblies that are positioned relatively far from the center of gyration of the head assembly. This distance tends to create relatively large moments during crusher operation which, in turn, creates vibration problems for the crusher. Also, in general, prior art crusher designs have emphasized counterweight mass distributions to balance the dynamic horizontal forces on the crusher, to the detriment of a balancing of moments acting on the crusher. The balancing of the moments acting on the crusher increases in importance in crusher designs seeking higher operational speeds, having relatively large crusher throw settings, and counterweight assemblies having a center of mass at a relatively large distance from the axis of gyration of the crusher head assembly.

To address these problems associated with existing eccentric cone crusher designs, the present invention provides an eccentric cone crusher having multiple counterweights. The counterweights are sized and positioned to balance mass distribution of the rotating components of the crusher, including the crusher head assembly and the eccentric assembly. The counterweights are generally located so that the forces and moments acting on the crusher during crusher operation are balanced, thereby permitting smooth and relatively vibration free operation of the crusher at a wide range of speeds and throws.

In one embodiment, the invention provides a cone crusher including a frame; a bowl supported on the frame; a crusher head for gyration about an axis, the crusher head being positioned in spaced relation to the bowl; an eccentric assembly supporting the crusher head and having a center of gravity off the axis of eccentric rotation; and at least two counterweights attached to the eccentric assembly.

In a preferred embodiment, the present invention provides a cone crusher as described above wherein the eccentric assembly has a thinner radial portion, a thicker radial portion generally opposite the thinner radial portion, an upper axial portion and a lower axial portion. A first counterweight is attached to the lower axial portion of the eccentric assembly generally opposite the thicker radial portion of the eccentric assembly, and a second counterweight is attached to a top of the upper axial portion generally opposite the thicker radial portion of the eccentric assembly. Preferably, the second counterweight has a height and a radial extent which permits the crusher head to be positioned over and into housing relation with the second counterweight.

One advantage of the present invention is that utilizing more than one weight permits greater flexibility in positioning the counterweights, which in turn enhances the ability to balance both unbalanced forces and moments. If the cone crusher is balanced against unbalanced forces and moments then the vitration induced in the foundation and/or structure by the crusher is minimized. Thus, the foundation design requirements are reduced saving substantial cost to the customer.

Another advantage of the present invention is that both upper and lower counterweights are located inside the crusher and are thus completely protected from wear caused by rock and dirt. Thus the magnitude of the balancing forces from the two counterweights remains unchanged for a given eccentric rotation speed.

Other features and advantages of the invention will become apparent to those skilled in the art upon review of the following detailed description, claims and drawings.

Figure 1:
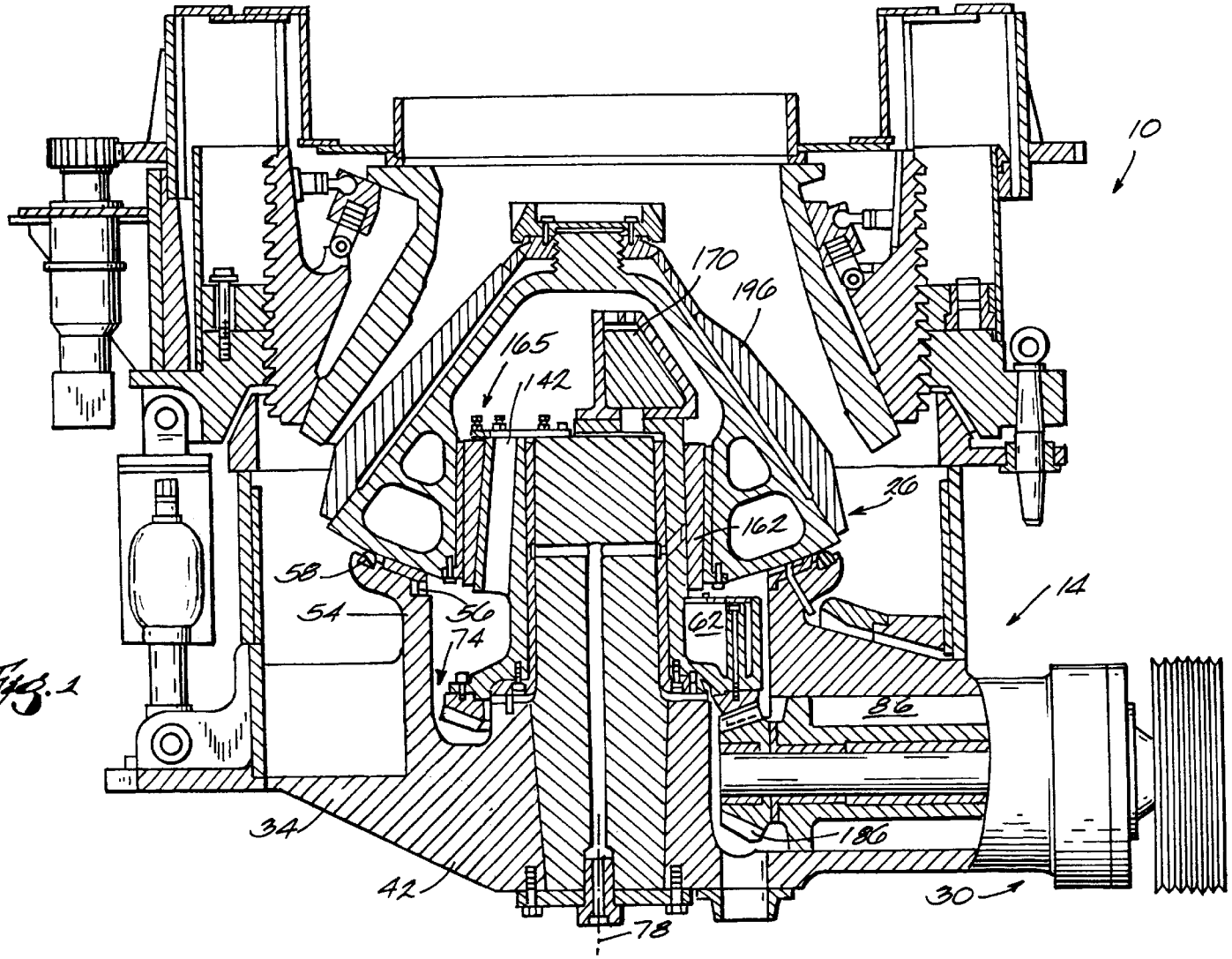
FIG. 1 is a cross-sectional view of a cone crusher embodying the present invention.
Figure 2:
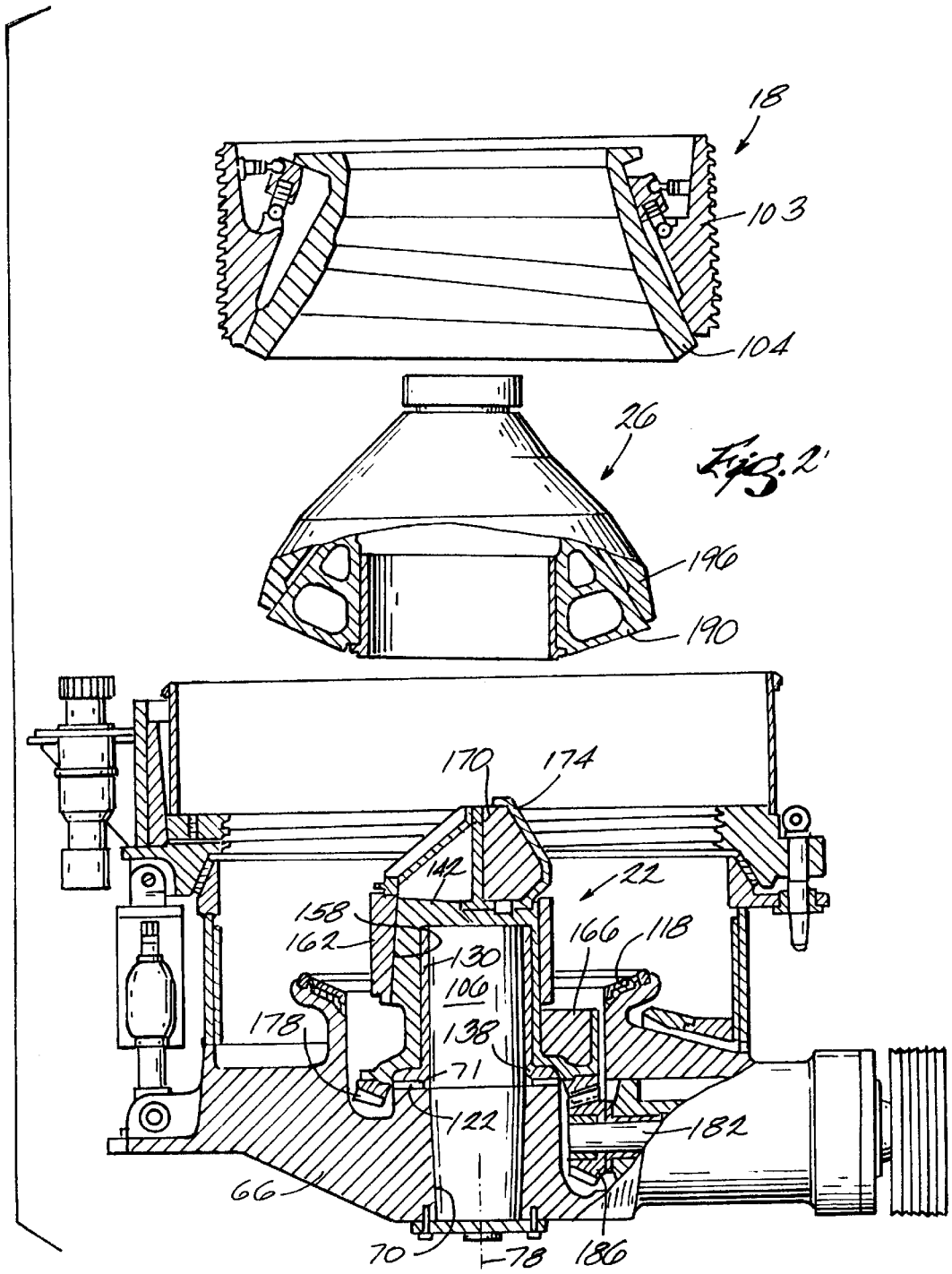
FIG. 2 is an exploded cross-sectional view of the cone crusher illustrated in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

The figures illustrate a cone crusher 10 which embodies the invention. The crusher 10 is operable to crush large aggregate and ore particles, such as rocks, into smaller particles. In general, the crusher 10 includes a frame assembly 14, a bowl assembly 18 supported by the frame assembly 14, an eccentric assembly 22 which is mounted on the frame assembly 14, a head assembly 26 which is fixed to the eccentric assembly 22 and which is supported by the frame assembly 14 for rotation relative to the frame assembly 14 and to the bowl assembly 18, and a drive system 30 for rotating the eccentric and head assemblies about a central crusher axis 78. The eccentricity of the eccentric assembly is offset by multiple counterweights 166, 170. Before describing the counterweights in detail, the surrounding structure of the cone crusher will be described.

Particularly, the frame assembly 14 includes a one-piece, integrally formed main frame 34. The central portion 42 of the main frame 34 includes a vertical wall or socket 54. The socket 54 defines a cup-like structure and extends up from the central portion 42 of the main frame 34 to an upper edge 56. The upper portion of the socket 54 splays radially outwardly from the upper edge 56 and defines a upwardly facing and inwardly sloping socket liner mounting surface 58. The socket 54 is integrally formed with the main frame 34, and supports thereon a substantial portion of the vertical load of the head assembly 26.

The main frame 34 is further described in the following co-pending U.S. patent application, which is assigned to the assignee hereof and which is incorporated herein by reference: Ser. No. 09/172,986, filed concurrently herewith and titled "Main Frame for Eccentric Cone Crusher" now pending.

The cone crusher 10 further includes a bowl 103 and a bowl liner 104 mounted on the bowl 103. The bowl liner 104 provides a generally frusto-conical crushing surface. A mantle 196 is mounted on the outer surface of the head 190 and provides another generally frusto-conical crushing surface. An annular bushing 206 is mounted on the inner surface of the head 190 and provides a sliding contact surface.

The frame assembly 14 also includes a main shaft 106 that is received by the main shaft bore 70. As discussed below, and as best shown in FIG. 1, the head assembly 26 and the eccentric assembly 22 are concentrically arranged on and about the main shaft 106.

The frame assembly 14 also includes a socket liner 118 located on and fixed to the socket liner mounting surface 58. The upper surface of the socket liner 118 engages and slidingly supports the underside of the crusher head assembly 26 and, with the head assembly 26, defines an interface which is in sliding contact during operation of the crusher 10.

The frame assembly 14 also includes an annular thrust bearing 122 mounted on the thrust bearing mounting surface 71 in surrounding relation to the main shaft 106. The frame assembly 14, and more specifically, the thrust bearing 122 and shaft 106, supports the eccentric assembly 22 on the hub 66. The vertical loads transferred through the head assembly 26 to the eccentric assembly 22 are transferred from the eccentric assembly 22 to the main frame 34 through the thrust bearing 122. The main shaft 106 provides lateral load bearing support for the eccentric assembly 22 and for the head assembly 26 during operation of the crusher 10.

The eccentric assembly 22 envelops the upper portion of the main shaft 106. More particularly, the eccentric assembly 22 includes an annular bushing 130 which has extending therethrough a bore. The bore receives the upper portion of the shaft 106 and provides a sliding contact interface with the cylindrical outer surface of the main shaft 106. A flange 138 extends radially from the lower end of the eccentric bushing 130 and overlies the thrust bearing 122 on the hub 66 of the main frame 34. The eccentric assembly has a thinner radial portion (depicted on the right side of the figures), a thicker radial portion generally opposite the thinner radial portion (depicted on the left side of the figures), an upper axial portion and a lower axial portion.

Although the eccentric assembly may be a single, integral element, the eccentric assembly preferably includes an inner eccentric member 142, and an outer eccentric member 162 movable relative to the inner eccentric member. The outer eccentric member 162 supports the crusher head 190. More specifically, the eccentric assembly 22 includes an inner eccentric member 142 which is mounted on, and is rotatable relative to, the upper portion of the shaft 106. The inner eccentric 142 is generally cylindrical and has upper and lower ends and a central bore extending between the ends. The bore is eccentrically positioned within the inner eccentric 142 with respect to the outer surface 158 of the inner eccentric 142. The inner eccentric bore houses and is fixed to the eccentric bushing 130 so as to be rotatable in common with the eccentric bushing 130 about the main shaft 106.

More particularly, the inner eccentric 142 is cylindrical, and the cylindrical wall thickness of the inner eccentric 142 varies from a minimum thickness (thinner radial portion of the inner eccentric) to a maximum thickness (thicker radial portion of the inner eccentric) generally opposite the minimum thickness. Also, the outer surface 158 of the inner eccentric 142 tapers at the top to provide a wedging surface for engaging the outer eccentric member 162.

The outer eccentric member 162 is supported by the inner eccentric 142 for selective rotational movement relative to the inner eccentric 142 but is fixed to the inner eccentric 142 by a locking assembly 165 during operation of the crusher 10. Similar to the inner eccentric 142, the outer eccentric 162 is preferably annular, and the wall thickness of the outer eccentric 162 varies from a minimum thickness to a maximum thickness opposite the minimum thickness. The inner and outer eccentrics 142, 162 are moveable relative to one another to vary the settings of the cone crusher 10. Ordinarily, the inner and outer eccentric members 142, 162 are fixed and rotate in common. However, the throw of the crusher 10 can be adjusted by rotating the inner eccentric 142 relative to the outer eccentric 162, and when such relative rotation is desired, the locking mechanism 165 is released to afford such adjustment.

The arrangement of inner and outer eccentrics 142, 162, the locking mechanism 165, and the variation of the crusher's operational settings are further described in the following co-pending U.S. patent application, which is assigned to the assignee hereof and which is fully incorporated herein by reference: Ser. No. 09/173,037 filed concurrently herewith and titled "Variable Throw Eccentric Cone Crusher and Method of Operating the Same" now pending.

The eccentric assembly 22 also includes an annular, continuous ring gear 178. The ring gear 178 is positioned in surrounding relation to the hub 66 and occupies the ring gear pocket 74 of the socket bore 62. The ring gear 178 is fixed to the lower end of the inner eccentric 142 and to the lower counterweight 166. The ring gear 178 has a lower, toothed face which is in driven engagement with the drive system 30. In this regard, the drive system 30 includes a counter shaft 182 housed in the countershaft bore 86 and a pillion 186 mounted on one end of the countershaft 182. A prime mover (not shown) rotatably drives the countershaft 182 and the pinion 186. The ring gear 178 meshes with the pinion 186 and is therefore in driven relation with the countershaft 182. Rotation of the pinion 186 drives the ring gear 178 and the remainder of the eccentric assembly 22 about the axis 78, which rotation also causes the head assembly 26 to rotate about the axis 78 and about the bowl assembly 18.

The eccentric assembly 22, including the lower counterweight 166 and the ring gear 178 fixed to the inner eccentric 142 may be removed without the need for taking apart the ring gear 178 or the counterweight assembly. Assembly and disassembly of the cone crusher is further described in the following co-pending U.S. patent application, which is assigned to the assignee hereof and which is fully incorporated herein by reference: Ser. No. 09/172,970, filed concurrently herewith and titled "Cone Crusher Having Integral Socket and Main Frame" now pending.

Turning now to the counterweights, at least two counterweights are positioned and sized to offset the asymmetric configurations of the eccentric assembly 22 and head assembly 26, and to balance the forces acting on the main shaft 106 during operation of the cone crusher 10. The required counterbalancing forces may be determined for the eccentric assembly and head assembly at median throw and median mantle wear. These balance conditions help to maintain balance over a greater time frame and greater range of operating conditions.

To achieve optimum balance conditions, the mass and center of gravity of the eccentric assembly 22 and head assembly 26 taken together should be offset by the mass and center of gravity of the counterweights 166, 170 taken together. Ideally, the center of gravity of the eccentric and head assemblies taken together with the counterweights is as close to the axis of eccentric rotation as possible in order to minimize the horizontal eccentricity.

The vertical component to the eccentricity may be counter balanced as well by utilizing multiple counterweights with at least one counterweight positioned vertically above the other(s). Preferably, the vertical position along the axis of rotation which represents the center of gravity of the counterweights taken together, is located as close as possible to the vertical position along the axis of rotation which represents the center of gravity of the eccentric and head assemblies taken together.

As mentioned previously, at least two counterweights are utilized in the cone crusher of the present invention. Each of the counterweights may be positioned where space is available along their rotational path around the axis. The weights should be positioned to avoid impeding the crushing action of the head. Thus, the counterweights are preferably not positioned at a grinding surface or a load bearing surface which supports the weight of the head assembly.

In general, it is preferred to position the counterweights as close to the axis of rotation as possible to minimize structural stresses, while still appropriately positioning the counterweights to minimize eccentricity. This may be achieved, for example, by placing the bulk of the weight required to balance the horizontal eccentricity directly over the shaft 106 as shown in the figures. In this position, the upper counterweight 170 preferably has more mass than the lower counterweight 166. Positioning a larger counterweight in this manner is advantageous, in part, because only a relatively small counterweight is needed further from the axis of rotation to counterbalance any remaining horizontal eccentricity; the same small counterweight (or another counterweight or set of counterweights) may be employed to address the vertical eccentricity. If one of the counterweights is positioned at or near the top end of the shaft 106, then the other counterweight(s) are likely to be positioned closer to the lower end of the shaft 106 to compensate for vertical imbalance, as necessary.

Each of the counterweights may be attached to the eccentric assembly 22 by any means conventional in the art, such as by a bolt, pin, or rivet. The counterweights may also be integrally formed with the eccentric assembly. In the illustrated embodiment of the crusher 10, the lower counterweight 166 is integrally formed with the lower end of the inner eccentric 142. However, it will be readily understood that the lower counterweight could also be in the form of an annular assembly that is bolted to the eccentric or is otherwise removably fastened to the inner eccentric 142. The counterweights should be mounted for movement in unison with the eccentric assembly as the eccentric rotates about the axis. If the eccentric assembly includes an inner eccentric and an outer eccentric member, then the counterweights are preferably attached to the inner eccentric member. Alternatively, the counterweights may be attached to the outer eccentric member.

Typically, the shape of the counterweights is not significant except to the extent the shape effects the center of gravity of the counterweight, and except that the counterweights must fit in the available space as the assembly rotates about its axis. If the upper counterweight is positioned above the shaft 106 as shown in the figures, then, preferably, the upper counterweight has a generally semicircular radial cross-section; this shape assists in keeping the weight positioned as close to the axis of rotation as possible.

The figures show a preferred embodiment in which the counterweights include a first counterweight attached to the lower axial portion of the eccentric assembly generally opposite the thicker radial portion of the eccentric assembly, and a second counterweight attached to a top of the upper axial portion generally opposite the thicker radial portion of the eccentric assembly. Specifically, a lower counterweight 166 and an upper counterweight 170 are fixed to the inner eccentric 142. The upper counterweight 170 is enclosed by a bracket 174 which is, in turn, mounted on the top of the upper axial portion of the inner eccentric 142. The bracket 174 is fitted within a recess formed in the top surface of the inner eccentric 142. The upper counterweight 170 is fixed to the inner eccentric 142 in a position immediately adjacent the axis of rotation 78 and to the side of the axis 78 opposite the thicker radial portion of the eccentric assembly 22. Desirably, the upper counterweight 170 has a height and radial extent that permits the crusher head assembly 26 to be positioned over and into housing relation with the upper counterweight. In this regard, the upper counterweight is preferably located vertically above the inner eccentric, and has a radial extent that is generally co-extensive or less than that of the outer eccentric 162. Thus, the head assembly 26 can house and directly contact the outer, peripheral surface of the outer eccentric 162, but can also be moved vertically off the eccentric assembly 22 without the necessity of removing the upper counterweight 170 from the eccentric assembly 22.

Similarly, the lower counterweight 166 is also fixed to the inner eccentric 142, and is generally opposite the thicker portion of the inner eccentric 142, i.e., on the same side of the axis 78 of rotation as the upper counterweight 170. The lower counterweight 166 is positioned vertically below the outer eccentric 162 and is fixed to the lower axial portion of the inner eccentric 142 to offset vertical imbalance. More particularly, when the eccentric assembly 22 is mounted on the main frame 34, the lower counterweight 166 is located within the socket bore 62 and is located below the head supporting surface provided by the socket 54 and socket liner 118. The vertical and horizontal balancing provided by the present invention reduces bending stresses and coupling along the axis of rotation.

Various features of the invention are set forth in the following claims.

I claim:

1. A cone crusher comprising:

a frame;

a bowl supported on the frame;

a crusher head for eccentric rotation about an axis, the crusher head being positioned in spaced relation to the bowl;

an eccentric assembly supporting the crusher head and having a center of gravity off the axis of eccentric rotation; and at least two counterweights attached to the eccentric assembly, wherein the at least two counterweights are mounted for movement in unison with the eccentric assembly as the eccentric assembly rotates about the axis, and wherein the at least two counterweights are located off the axis of eccentric rotation opposite the center of gravity of the eccentric assembly.

2. The cone crusher as set forth in claim 1 wherein the cone crusher includes no more than two counterweights.

3. The cone crusher as set forth in claim 1 wherein the eccentric assembly includes an inner eccentric member, and an outer eccentric member movable relative to the inner eccentric member, said outer eccentric member supporting the crusher head.

4. The cone crusher as set forth in claim 1 wherein the eccentric assembly has a thinner radial portion, a thicker radial portion generally opposite the thinner radial portion, an upper axial portion and a lower axial portion; and said at least two counterweights include a first counterweight attached to the lower axial portion of the eccentric assembly generally opposite the thicker radial portion of the eccentric assembly, and a second counterweight attached to a top of the upper axial portion generally opposite the thicker radial portion of the eccentric assembly.

5. The cone crusher as set forth in claim 4 wherein the eccentric assembly rotates about the axis of eccentric rotation, and the second counterweight is positioned immediately adjacent the axis of eccentric rotation and on the side of the axis of eccentric rotation generally opposite the thicker radial portion of the eccentric assembly.

6. The cone crusher as set forth in claim 4 wherein the second counterweight has a generally semicircular radial cross-section.

7. The cone crusher as set forth in claim 4 wherein the first counterweight is integrally formed with the eccentric assembly.

8. The cone crusher as set forth in claim 4 wherein the second counterweight is integrally formed with the eccentric assembly.

9. The cone crusher of claim 4 wherein the second counterweight has greater mass than the first counterweight.

10. The cone crusher of claim 4 wherein the second counterweight has a height and a radial extent which permits the crusher head to be positioned over and into housing relation with the second counterweight.

11. The cone crusher of claim 4 wherein the eccentric assembly includes an inner eccentric member, and an outer eccentric member movable relative to the inner eccentric member, said outer eccentric member supporting the crusher head; wherein the inner eccentric member has a thicker radial portion and a thinner radial portion; and wherein the first counterweight is attached to the inner eccentric member generally opposite the thicker portion of the inner eccentric member.

12. The cone crusher of claim 11 wherein the second counterweight is positioned vertically above the inner eccentric.

13. A cone crusher comprising:

a frame;

a bowl supported on the frame;

a crusher head for eccentric rotation about an axis, the crusher head being positioned in spaced relation to the bowl;

an eccentric assembly supporting the crusher head and having a center of gravity off the axis of eccentric rotation;

a first counterweight attached to the eccentric; and a second counterweight attached to the eccentric, wherein the first counterweight and the second counterweight are mounted for movement in unison with the eccentric assembly as the eccentric assembly rotates about the axis, and wherein the first and second counterweights are located off the axis of eccentric rotation opposite the center of gravity of the eccentric assembly.

14. The cone crusher as set forth in claim 13 wherein the eccentric assembly includes an inner eccentric member and an outer eccentric member movable relative to the inner eccentric member, said outer eccentric member supporting the crusher head.

15. The cone crusher as set forth in claim 13 wherein the eccentric assembly has a thinner radial portion, a thicker radial portion generally opposite the thinner radial portion, an upper axial portion and a lower axial portion; wherein the first counterweight is attached to tile lower axial portion of the eccentric assembly generally opposite the thicker radial portion of the eccentric assembly; and wherein the second counterweight is attached to the upper axial portion generally opposite the thicker radial portion of the eccentric assembly.

16. The cone crusher of claim 13 wherein the second counterweight has a height and a radial extent which permits the crusher head to be positioned over and into housing relation with the second counterweight.

17. The cone crusher of claim 14 wherein the inner eccentric member has a thicker radial portion and a thinner radial portion; and wherein the first counterweight is fixed to the inner eccentric member generally opposite the thicker portion of the inner eccentric member.

18. The cone crusher as set forth in claim 15 wherein the eccentric assembly rotates about the axis of eccentric rotation, and the second counterweight is positioned immediately adjacent the axis of eccentric rotation and on the side of the axis of eccentric rotation generally opposite the thicker radial portion or the eccentric assembly.

19. The cone crusher of claim 15 wherein the second counterweight is attached to a top of the upper axial portion of the eccentric assembly.

20. A cone crusher comprising:

a frame;

a bowl supported on the frame;

a crusher head for eccentric rotation about an axis, the crusher head being positioned in spaced relation to the bowl;

an eccentric assembly including an inner eccentric member, and an outer eccentric member movable relative to the inner eccentric member, said outer eccentric member supporting the crusher head, said eccentric assembly having a center of gravity off the axis of eccentric rotation, the eccentric assembly has a thinner radial portion, a thicker radial portion generally opposite the thinner radial portion, an upper axial portion and a lower axial portion;

a first counterweight attached to the lower axial portion of the eccentric assembly generally opposite the thicker radial portion of the eccentric assembly; and a second counterweight attached to a top of the upper axial portion generally opposite the thicker radial portion of the eccentric assembly, the second counterweight has a height and a radial extent which permits the crusher head to be positioned over and into housing relation with the second counterweight.

21. A cone crusher comprising:

a frame;

a bowl supported on the frame;

a crusher head for eccentric rotation about an axis, the crusher head being positioned in spaced relation to the bowl;

an eccentric assembly supporting the crusher head and having a center of gravity off the axis of eccentric rotation; and at least two counterweights attached to the eccentric assembly such that the at least two counterweights are co-axial with the axis of eccentric rotation, and wherein the at least two counterweights are located off the axis of eccentric rotation opposite the center of gravity of the eccentric assembly.

22. A cone crusher comprising:

a frame;

a main shaft integral with the frame, the main shaft having a lower end and an upper end;

a bowl supported on the frame;

a crusher head for eccentric rotation about an axis, the crusher head being positioned in spaced relation to the bowl, the crusher head being supported by the main shaft;

an eccentric assembly supporting the crusher head and having a center of gravity off the axis of eccentric rotation, the eccentric assembly including an upper axial portion and a lower axial portion;

a first counterweight attached to the lower axial portion of the eccentric assembly; and a second counterweight attached to a top of the upper axial portion of the eccentric assembly and located above the upper end of the main shaft.

23. A cone crusher comprising:

a frame;

a bowl supported on the frame;

a crusher head for eccentric rotation about an axis, the crusher head being positioned in spaced relation to the bowl;

an eccentric assembly supporting the crusher head and having a center of gravity off the axis of eccentric rotation; and at least two counterweights attached to the eccentric assembly, wherein the at least two counterweights are mounted for movement in unison with the eccentric assembly as the eccentric assembly rotates about the axis, and wherein the eccentric assembly has a thinner radial portion, a thicker radial portion generally opposite the thinner radial portion, an upper axial portion and a lower axial portion; and said at least two counterweights include a first counterweight attached to the lower axial portion of the eccentric assembly generally opposite the thicker radial portion of the eccentric assembly, and a second counterweight attached to a top of the upper axial portion generally opposite the thicker radial portion of the eccentric assembly.

24. The cone crusher as set forth in claim 23 wherein the cone crusher includes no more than two counterweights.

25. The cone crusher as set forth in claim 23 wherein the eccentric assembly includes an inner eccentric member, and an outer eccentric member movable relative to the inner eccentric member, said outer eccentric member supporting the crusher head.

26. The cone crusher as set forth in claim 23 wherein the eccentric assembly rotates about the axis of eccentric rotation, and the second counterweight is positioned immediately adjacent the axis of eccentric rotation and on the side of the axis of eccentric rotation generally opposite the thicker radial portion of the eccentric assembly.

27. The cone crusher as set forth in claim 23 wherein the second counterweight has a generally semicircular radial cross-section.

28. The cone crusher as set forth in claim 23 wherein the first counterweight is integrally formed with the eccentric assembly.

29. The cone crusher as set forth in claim 23 wherein the second counterweight is integrally formed with the eccentric assembly.

30. The cone crusher of claim 23 wherein the second counterweight has greater mass than the first counterweight.

31. The cone crusher of claim 23 wherein the second counterweight has a height and a radial extent which permits the crusher head to be positioned over and into housing relation with the second counterweight.

32. The cone crusher of claim 23 wherein the eccentric assembly includes an inner eccentric member, and an outer eccentric member movable relative to the inner eccentric member, said outer eccentric member supporting the crusher head; wherein the inner eccentric member has a thicker radial portion and a thinner radial portion; and wherein the first counterweight is attached to the inner eccentric member generally opposite the thicker portion of the inner eccentric member.

33. The cone crusher of claim 32 wherein the second counterweight is positioned vertically above the inner eccentric.

34. A cone crusher comprising:

a frame;

a bowl supported on the frame;

a crusher head for eccentric rotation about an axis, the crusher head being positioned in spaced relation to the bowl;

an eccentric assembly supporting the crusher head and having a center of gravity off the axis of eccentric rotation;

a first counterweight attached to the eccentric; and a second counterweight attached to the eccentric, wherein the first counterweight and the second counterweight are mounted for movement in unison with the eccentric assembly as the eccentric assembly rotates about the axis, and wherein the eccentric assembly has a thinner radial portion, a thicker radial portion generally opposite the thinner radial portion, an upper axial portion and a lower axial portion; wherein the first counterweight is attached to the lower axial portion of the eccentric assembly generally opposite the thicker radial portion of the eccentric assembly; and wherein the second counterweight is attached to the upper axial portion generally opposite the thicker radial portion of the eccentric assembly.

35. The cone crusher as set forth in claim 34 wherein the eccentric assembly includes an inner eccentric member and an outer eccentric member movable relative to the inner eccentric member, said outer eccentric member supporting the crusher head.

36. The cone crusher of claim 35 wherein the inner eccentric member has a thicker radial portion and a thinner radial portion; and wherein the first counterweight is fixed to the inner eccentric member generally opposite the thicker portion of the inner eccentric member.

37. The cone crusher as set forth in claim 34 wherein the eccentric assembly rotates about the axis of eccentric rotation, and the second counterweight is positioned immediately adjacent the axis of eccentric rotation and on the side of the axis of eccentric rotation generally opposite the thicker radial portion or the eccentric assembly.

38. The cone crusher of claim 34 wherein the second counterweight is attached to a top of the upper axial portion of the eccentric assembly.

39. A cone crusher comprising:

a frame;

a bowl supported on the frame;

a crusher head for eccentric rotation about an axis, the crusher head being positioned in spaced relation to the bowl;

an eccentric assembly supporting the crusher head and having a center of gravity off the axis of eccentric rotation;

a first counterweight attached to the eccentric; and a second counterweight attached to the eccentric, wherein the first counterweight and the second counterweight are mounted for movement in unison with the eccentric assembly as the eccentric assembly rotates about the axis, and wherein the second counterweight has a height and a radial extent which permits the crusher head to be positioned over and into housing relation with the second counterweight.

* * * * *